US005594487A

United States Patent [19]

Nuita et al.

[11] Patent Number: 5,594,487

[45] Date of Patent: Jan. 14, 1997

[54] THERMAL HEAD SUPPORTING DEVICE

[75] Inventors: Akira Nuita; Tsutomu Fujiwara; Hisao Suzuki; Tsugio Narushima; Akira Suzuki; Mamoru Tago; Eiichi Furuya, all of Shizuoka, Japan

[73] Assignee: Kabushiki Kaisha TEC, Shizuoka, Japan

[21] Appl. No.: 322,338

[22] Filed: Oct. 13, 1994

[30] Foreign Application Priority Data

| | | | |
|---|---|---|---|
| Oct. 13, 1993 | [JP] | Japan | 5-255340 |
| Oct. 13, 1993 | [JP] | Japan | 5-255341 |
| May 13, 1994 | [JP] | Japan | 6-100243 |

[51] Int. Cl.[6] ..... B41J 25/304

[52] U.S. Cl. ..... 347/197

[58] Field of Search ..... 347/197, 198; 400/120.16, 120.17

[56] References Cited

U.S. PATENT DOCUMENTS 5,005,026 4/1991 Sakai ..... 347/197

FOREIGN PATENT DOCUMENTS 3-23443 3/1991 Japan ..... 347/197

*Primary Examiner*—Huan H. Tran

*Attorney, Agent, or Firm*—Oblon, Spivak, McClelland, Maier & Neustadt, P.C.

[57] ABSTRACT

The thermal head supporting device of the invention comprises a pair of positioning members disposed at both sides of a platen, a head press/release mechanism movable toward and away from the platen, and a head unit coupled with the head press/release mechanism. The positioning members are disposed coaxially with the platen. The head unit is formed of a head supporting member removably coupled to the head press/release mechanism with a predetermined play, a thermal head supported on the head supporting member and having a plurality of heating elements arranged in a straight line thereon and in confronting relationship with the platen, and a pair of engagement members attached to both sides of the thermal head adjustably for position, and each of the engagement members has a cutting formed therein allowing each positioning member to be removably fitted therein.

13 Claims, 11 Drawing Sheets

THERMAL HEAD SUPPORTING DEVICE

BACKGROUND OF THE INVENTION

1. Field of the Invention

The invention relates to a thermal head supporting device for use in a thermal printer.

2. Description of the Related Art

In the printing operation with a thermal printer, it is necessary that the thermal head is pressed against the printing paper and ink ribbon on the platen. On the other hand, when the printing paper or ink ribbon is to be inserted between the platen and the thermal head or when only the printing paper is to be fed, it is necessary that the thermal head is separated from the platen. Accordingly, there have been made various proposals for structures supporting the thermal head for movement toward and away from the platen.

For example, in the gazette of Japanese Patent Laid-open No. Hei 2-139268, there is disclosed a structure in which a frame supporting the thermal head is urged in the direction it separates from the platen, the frame is pressed to the platen by a cam, and the frame together with the thermal head is separated from the platen as the cam changes its rotational position.

Further, in the gazette of Japanese Patent Laid-open No. Hei 2-281984, there is disclosed a structure in which a head supporting plate to which the thermal head is fixed is swingably supported on a supporting shaft, the thermal head is pressed to the platen by swinging of the head supporting plate caused by urges of independent springs acting on both sides of the head supporting plate, and then both ends of the supporting shaft together with the head supporting plate are slightly vibrated by means of slits formed in opposing side plates, so that the thermal head is pressed to the platen with uniform pressure all along the width of the thermal head.

Further, in the gazette of Japanese Patent Publication No. Sho 55-39465 (Japanese Patent Laid-open No. Sho 52-119337), there is disclosed a structure in which the thermal head is fixed to a block via a coupling member, the assembly of the thermal head, the coupling member, and the block is supported with a gimbal joint, and the block is pressed by a spring so that the thermal head is pressed to the platen, or a rod provided on the block is pulled with a hook so that the thermal head is separated from the platen.

Points of problem in the related arts will be described below.

In the invention disclosed in the gazette of Japanese Patent Laid-open No. Hei 2-139268, a shaft serving as the fulcrum of rotation is passed through the frame supporting the thermal head. Therefore, in assembling or maintenance, the work to mount and demount the frame together with the thermal head is difficult. Further, while there are arranged multiple heating elements on the thermal head along the axial direction of the platen, the work to keep the line of arrangement of the heating elements parallel to the platen is impossible or very difficult.

In the invention disclosed in the gazette of Japanese Patent Laid-open No. Hei 2-281984, since the supporting shaft is passed through the side plates and the head supporting plate, the work to mount and demount the thermal head together with the head supporting plate is difficult. Further, although it is possible to make uniform the pressure of the thermal head on the platen, the adjustment to keep the line of arrangement of the heating elements on the thermal head in parallel with the platen is supposed to be very difficult.

In the invention disclosed in the gazette of Japanese Patent Publication No. Sho 55-39465, since the coupling member is supported with a gimbal joint, it is supposed that the coupling member is exchanged together with the thermal head. Further, when the gimbal joint is used, the line of arrangement of the heating elements on the thermal head cannot be adjusted to be parallel to the platen along the direction of the paper feed.

Besides, in the thermal head assemblies disclosed in the gazettes, the line of arrangement of the heating elements on the thermal head cannot be adjusted to be parallel to the platen along the direction of the paper feed, in the state of the thermal head assembly being separated from the printer as a single unit.

SUMMARY OF THE INVENTION

An object of the invention is to provide a thermal head supporting device in which the work to adjust the line of arrangement of the heating elements on the thermal head to be parallel to the platen is easily executed.

Another object of the invention is to provide a thermal head supporting device in which the work of mounting and dismounting the thermal head is easy.

Still another object of the invention is to provide a thermal head supporting device in which the line of arrangement of the heating elements on the thermal head can be adjusted to be parallel to the platen in the state of the thermal head assembly being removed from the printer.

A further object of the invention is to provide a thermal head supporting device in which the printing paper is prevented from skewing.

A still further object of the invention is to provide a thermal head supporting device in which the work for exchanging the ink ribbon is easy.

The invention comprises a pair of positioning members of the same shape and size disposed at both sides of a platen coaxially therewith, a head press/release mechanism movable toward and away from the platen, and a head unit coupled with the head press/release mechanism. The head unit is formed of a head supporting member removably coupled to the head press/release mechanism with a predetermined play, a thermal head supported on a head supporting member and having heating elements provided thereon in confronting relationship with the platen, and a pair of engagement members attached to both sides of the thermal head adjustably for position. These engagement members have cuttings of the same shape and size formed therein for allowing the positioning members to be removably fitted therein. Accordingly, the line of arrangement of the heating elements on the thermal head can be held parallel to the center axis of the platen by assembling the head unit by attaching the engagement members to both sides of the thermal head, with positional adjustments made such that the straight line connecting the centers of the cuttings formed in the engagement members is held parallel to the line of arrangement of the heating elements on the thermal head, and coupling the head unit to the head press/release mechanism and the positioning members provided at both sides of the platen. More specifically, if the straight line connecting the centers of the cuttings formed in the engagement members is adjusted to be parallel to the line of arrangement of the heating elements on the thermal head, then the line of arrangement of the heating elements on the thermal head becomes parallel to the center axis of the platen just by fitting the positioning members into the cuttings formed in the engagement members. Since, at this time, the head unit has a predetermined play with respect to the head press/release mechanism, the straight line connecting the centers of the cuttings in the engagement members can be easily aligned with the center axis of the platen.

BRIEF DESCRIPTION OF THE DRAWINGS

The invention will be described with reference to the drawings, in which.

DETAILED DESCRIPTION OF THE PREFERRED EMBODIMENTS

Figure 1:
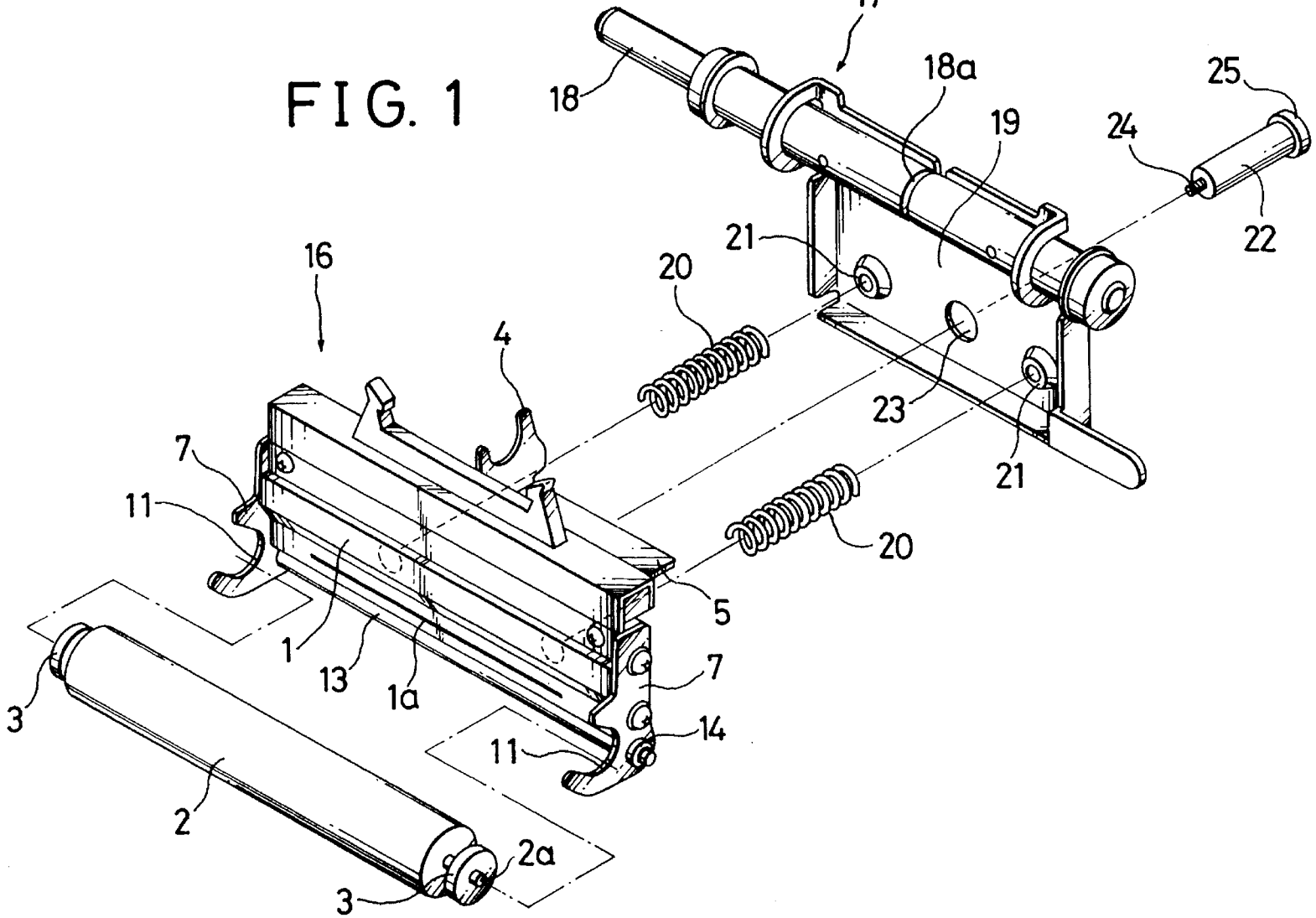
FIG. 1 is an exploded view in perspective of a platen, a head unit, and a head press/release mechanism as a first embodiment of the invention.

A first embodiment of the invention will be described with reference to FIG. 1 to FIG. 11. As shown in FIG. 1, the thermal head supporting device of the embodiment comprises concentric circular members 3 as positioning members provided at both sides of the platen 2, a head press/release mechanism 17 movable toward and away from the platen 2, and a head unit 16 coupled with the head press/release mechanism 17 and the concentric circular member 3.

Structure of the concentric circular member 3

Figure 2:
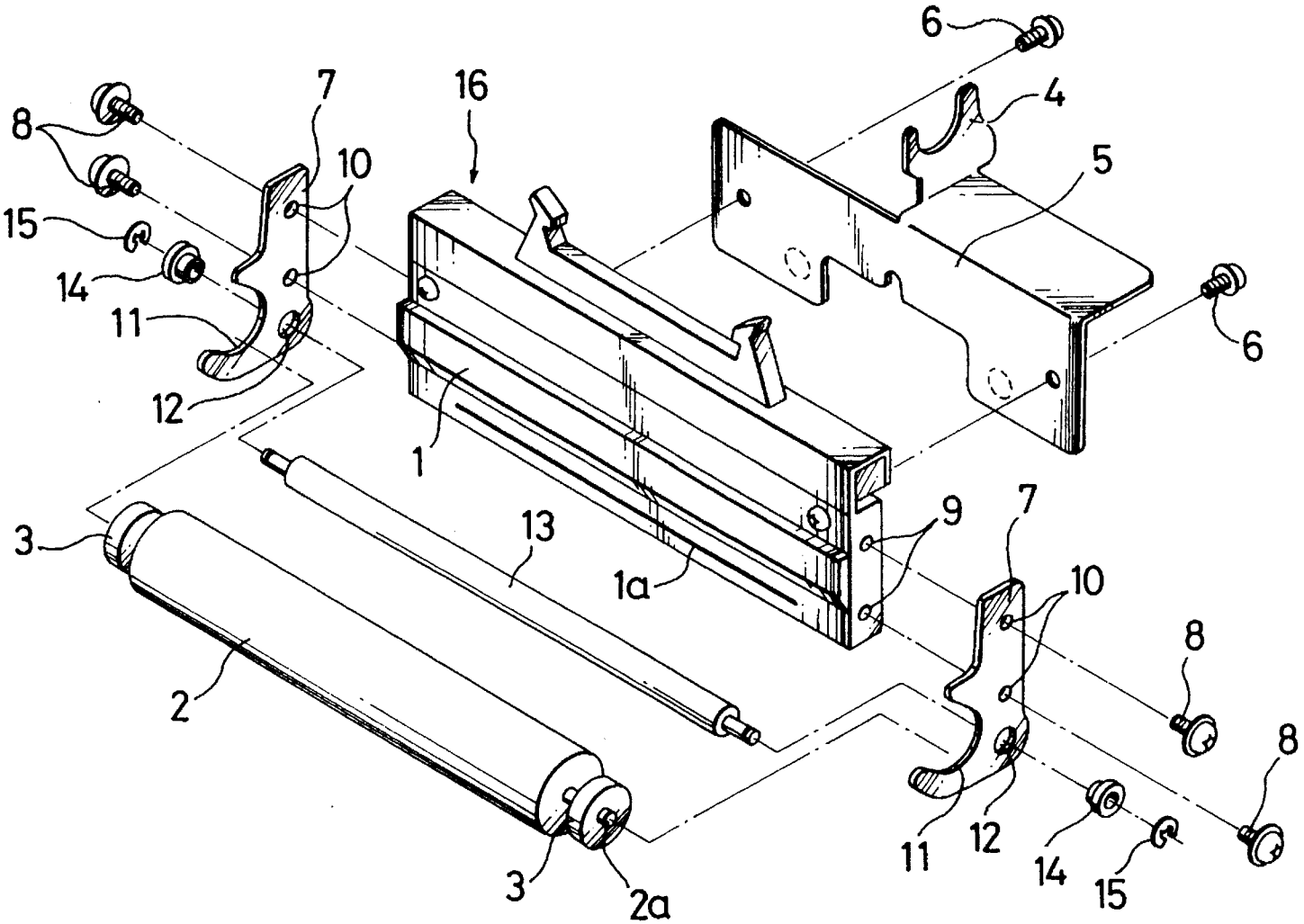
FIG. 2 is an exploded view in perspective of the head unit.
Figure 3:
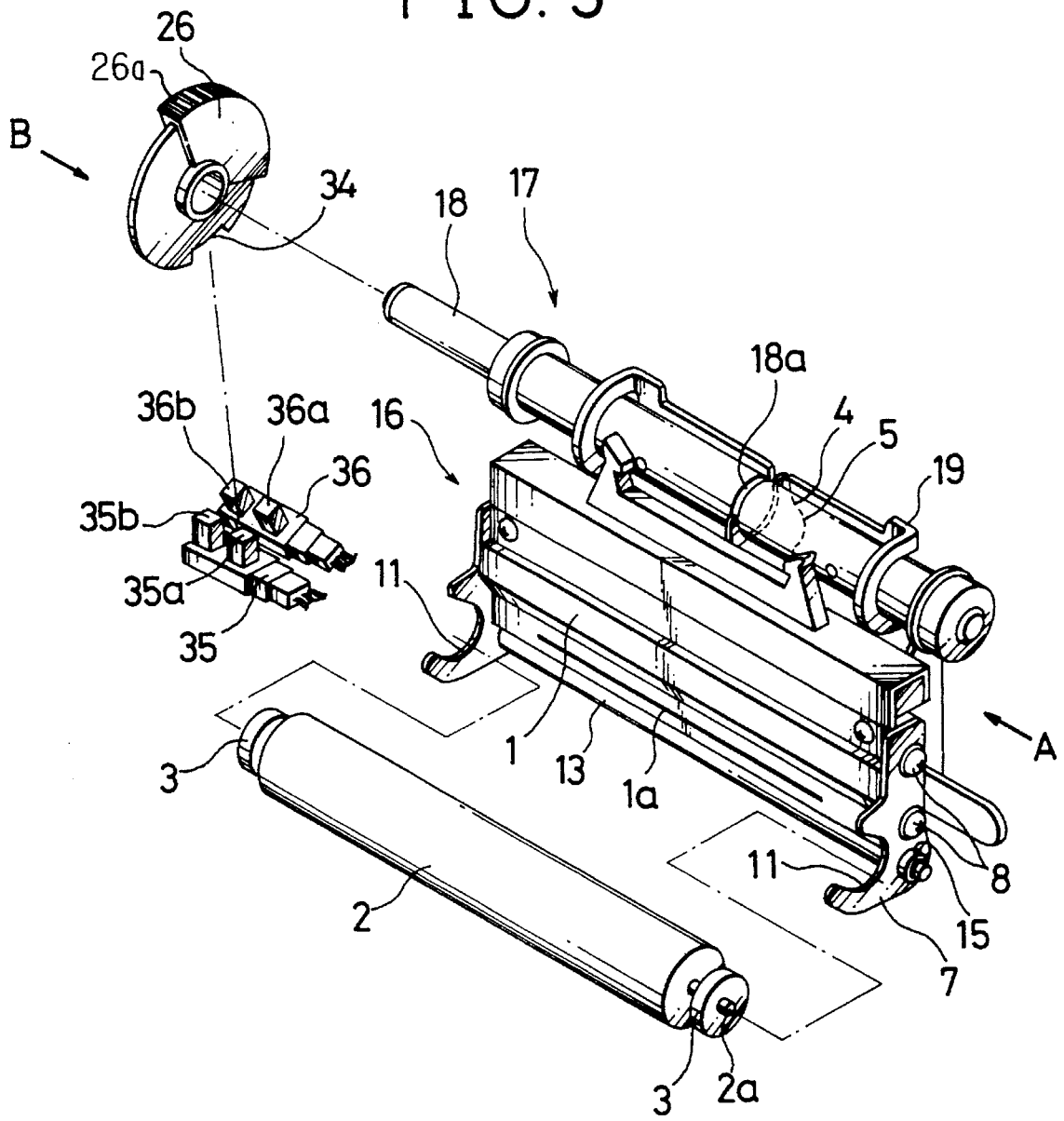
FIG. 3 is a perspective view of the whole device.

As shown in FIG. 1 to FIG. 3, the concentric circular members 3 are formed of a pair of disk-like members of the same shape and size. The concentric circular members 3 are attached at their center to both ends of the center shaft 2*a* of the platen 2 for rotation around it. Hence, the concentric circular members 3 are arranged coaxially with the platen 2.

The platen 2 is rotatably fixed in position in the printer body, to which the thermal head supporting device of the embodiment is applied, and driven to rotate by a later described platen motor 110.

Structure of the head unit 16

The head unit 16 includes the thermal head 1. The thermal head 1 has multiple heating elements 1*a*arranged to be parallel to the center axis of the platen 2. As shown in FIG. 2, a plate-shaped head supporting member 5 provided with a semicircular fitting piece 4 is attached to the back side of the thermal head 1 with screws 6. To both sides of the thermal head 1, engagement members 7 are fixed with screws 8 adjustably for position. Namely, the engagement members 7 on the left and right are formed by the same metallic press die. Each of the engagement members 7 has fixing holes 10, which are in confronting relationship with screw holes 9 formed in either side face of the thermal head 1 and have such a large size that allows the screw 8 to pass therethrough with a play, a cutting 11 in which each of the concentric circular members 3 aligned with the platen 2 is detachably fitted, and a bearing receiving hole 12. In the bearing receiving hole 12, a bearing 14 as a roller holding member for rotatably holding each end of a ribbon guide roller 13 is fitted. Reference numeral 15 denotes a snap ring fixed to the end portion of the ribbon guide roller 13 projecting from the bearing 14. The head unit 16 is made up of the thermal head 1, head supporting member 5, engagement members 7, and the ribbon guide roller 13. The engagement members 7 may be integrally formed with the head supporting member 5 at its both ends, but higher dimensional accuracy can be obtained by forming them separately as done in the present embodiment.

Structure of the head press/release mechanism 17

Now, mainly referring to FIG. 1, structure the of the head press/release mechanism 17 allowing the head unit 16 to approach to and separate from the platen 2 will be described. The head press/release mechanism 17 includes a center shaft 18 as an input portion driven by a head lift motor 31, referred to as a motor later, and a presser plate 19 fixedly fit in the center shaft 18. On both sides of the inner face of the presser plate. 19, there are formed bosses 21 supporting one end portions of springs 20 for pressing the head supporting member 5 and, in the center thereof, there is formed a circular hole 23 for allowing a screw 22 as a stopper to be inserted therethrough. At one end of the screw 22, there is formed a screw 24 to be screwed into the head supporting member 5 and, at the other end, there is formed a flange 25. Only the portion of the flange 25 of the screw 22 is formed larger in diameter than the circular hole 23 and the other portion is formed smaller in diameter than the circular hole 23. In the middle of the center shaft 18, there is a circular groove 18*a* formed around the center shaft 18 allowing the fitting piece 4 of the head supporting member 5 to be fitted therein so that the fitting piece 4 is removably held on the center shaft 18. The circular groove 18*a* is formed to have a width allowing the fitting piece 4 to be held therein with a predetermined play. Further, the cuttings 11 formed in the engagement members 7 attached to the thermal head 1 are formed so as to fit on the concentric circular members 3 attached to the platen 2 when the head unit 16 is swung while the fitting piece 4 is fitted in the circular groove 18*a*.

Structure for driving the head press/release mechanism 17

Figure 4:
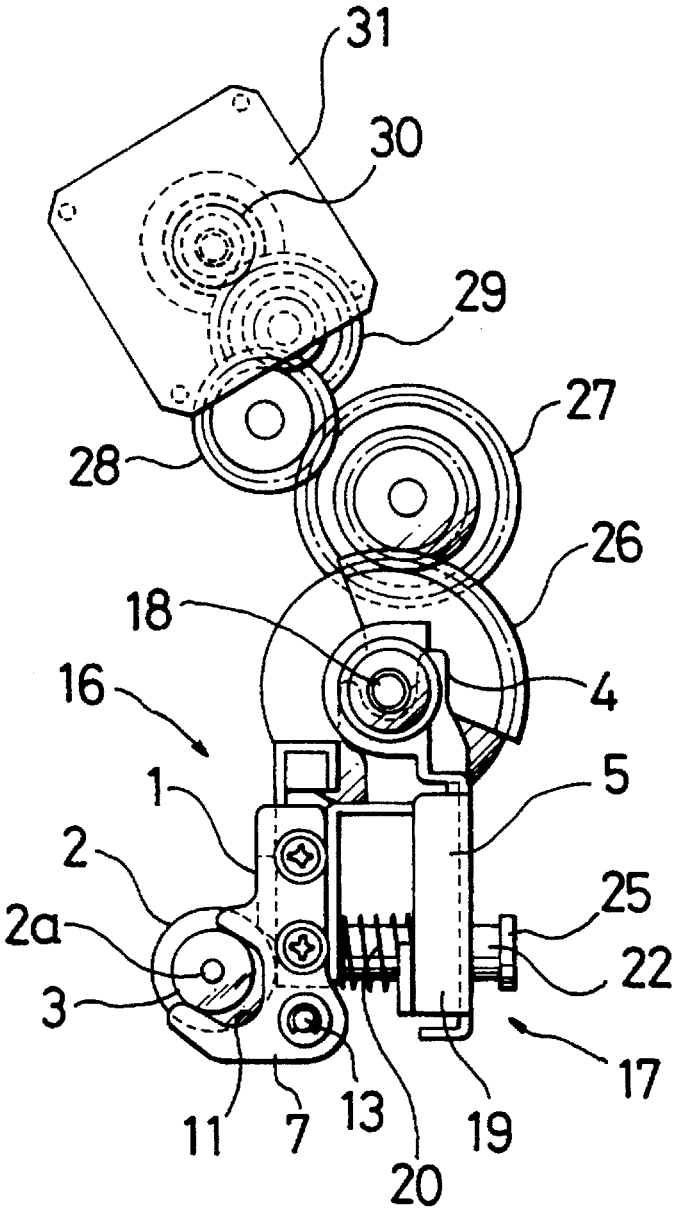
FIG. 4 is a side view of the whole device in the direction of the arrow A in FIG. 3.

The head lift motor 31 is coupled with the center shaft 18 through a gear train as shown in FIG. 4. More specifically, as shown in FIG. 3–FIG. 5, a drive gear 26 having a fan-shaped toothed portion 26*a* is fixedly attached to one end of the center shaft 18, and the drive gear 26 is coupled to the head lift motor 31 rotatable in both normal and reverse directions, through idler gears 27, 28, and 29 and a motor gear 30.

Structure for detecting the position of the thermal head 1

Figure 5:
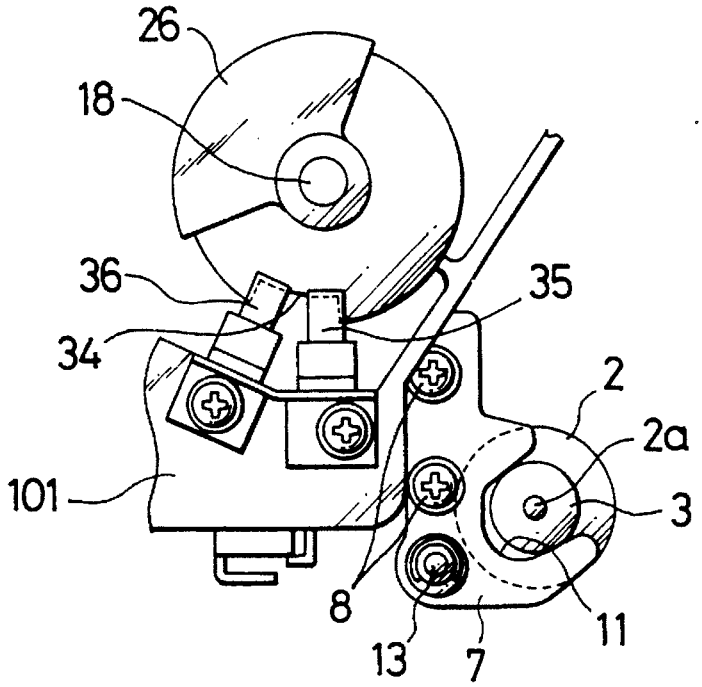
FIG. 5 is a side view of the whole device in the direction of the arrow B in FIG. 3.

At one portion of the circumference of the drive gear 26, there is formed a cutting for detection 34 as clearly shown in FIG. 3 and FIG. 5. The cutting for detection 34 is used for detecting in which of the following three relative positions of the thermal head 1 and the platen 2 the thermal head 1 is: a stand-by position where the thermal head 1 is set back from the platen 2 prior to the printing; a printing position where the thermal head 1 is pressed to the platen 2 to make printing; and a ribbon exchange position where the thermal head 1 is set further back from the platen 2 than in the stand-by position. In order to carry out such detection, there are provided photosensors 35 and 36 of a transmission type as parts of position detection means for detecting the position of the drive gear 26 in its rotating direction through the detection of the cutting for detection 34. The photosensors 35 and 36 include light emitting portions 35*a* and 36*a* and light receiving portions 35*b* and 36*b*, respectively, and the light emitting portions 35*a* and 36*a* and the light receiving portions 35*b* and 36*b* are disposed to oppose each other across the cutting for detection 34. Of the photosensors 35 and 36, the photosensor 35 is for detecting the stand-by position and constitutes a portion of stand-by position detection means and the photosensor 36 is for detecting the printing position and constitutes a portion of printing position detection means.

FIG. 5 is a side view of the thermal head holding device in the direction of the arrow B in FIG. 3. The photosensor 35 for detecting stand-by position is fixed on a side frame 101 of the printer body, so that it is located vertically below the center shaft 18. The photosensor 36 for detecting printing position is fixed on the side frame 101 so as to be located at a distance from the photosensor 35 along the circumference of the cutting for detection 34. The photosensors 35 and 36 produce changes in their outputs as the position of the cutting for detection 34 relative to the photosensors 35 and 36 is changed and the position of the head press/release mechanism 17 is detected through detection of the changes. Thus, the position of the thermal head 1 can be indirectly detected.

More specifically, each of the photosensors 35 and 36, set in their respective positions, is adapted to turn on when it detects the cutting for detection 34 and turn off when it does not detect it. The position of the thermal head 1 is detected according to the combinations of the outputs of the photosensor 35 and 36. Now, the positional relationship of the photosensors 35 and 36 and the cutting for detection 34 and the positional relationship of the thermal head 1 and the platen 2 will be described in more concrete terms with reference to FIGS. 6(A) and 6(B) to FIGS. 8(A) and 8(B).

Figure 6A:
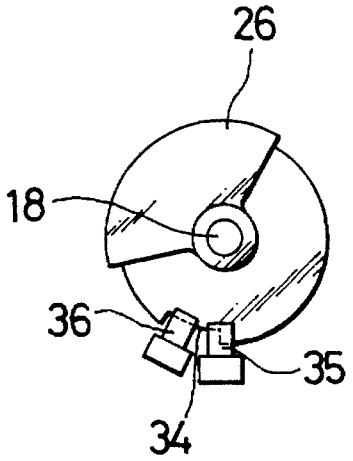
FIG. 6(A) is a side view showing the positional relationship between a cutting for detection formed in a drive gear and sensors when the thermal head is in its stand-by position.
Figure 6B:
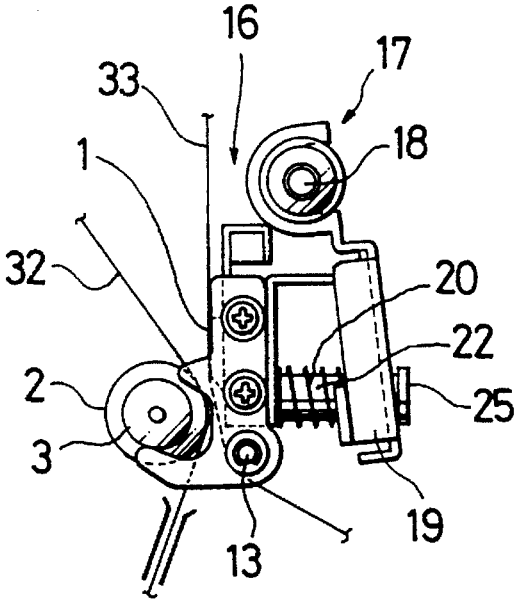
FIG. 6(B) is a side view showing the positional relationship between the thermal head and the platen when the thermal head is in the stand-by position.
Figure 7A:
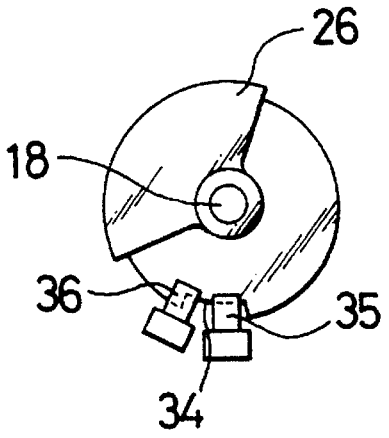
FIG. 7(A) is a side view showing the positional relationship between the cutting for detection formed in the drive gear and sensors when the thermal head is in its printing position.
Figure 7B:
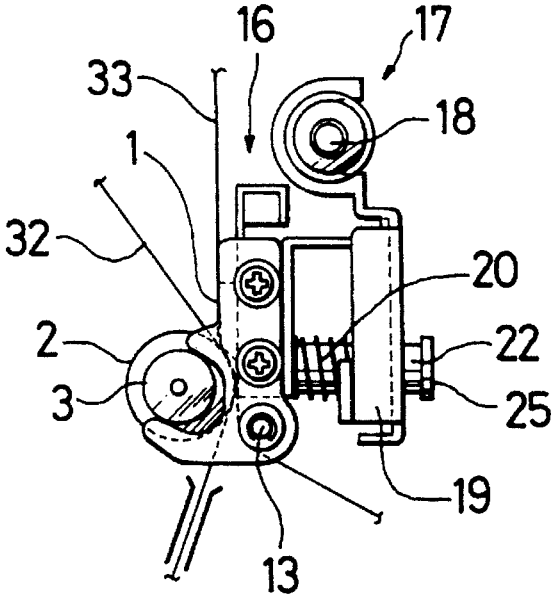
FIG. 7(B) is a side view showing the positional relationship between the thermal head and the platen when the thermal head is in the printing position.
Figure 8A:
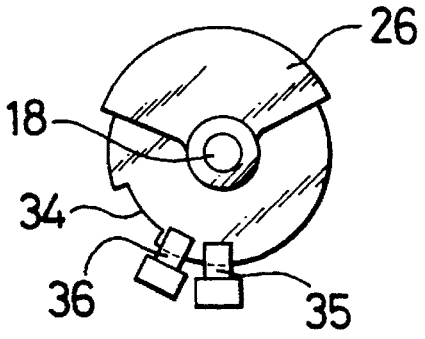
FIG. 8(A) is a side view showing the positional relationship between the cutting for detection formed in the drive gear and sensors when the thermal head is in its ribbon exchange position.
Figure 8B:
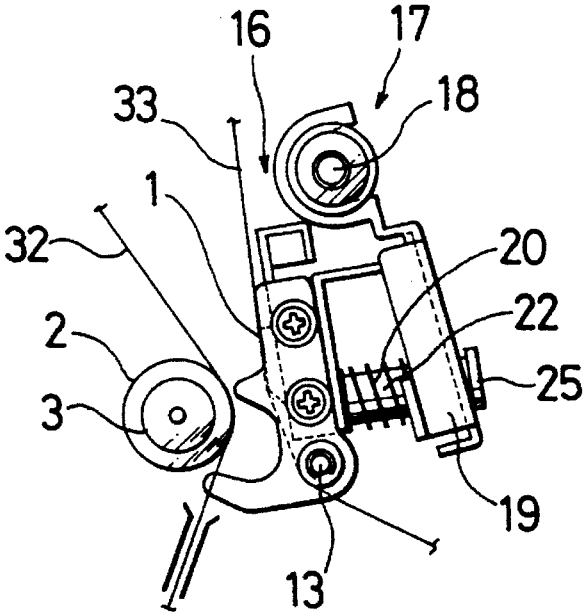
FIG. 8(B) is a side view showing the positional relationship between the thermal head and the platen when the thermal head is in the ribbon exchange position.

FIG. 6(A), FIG. 7(A), and FIG. 8(A) are side views in the direction of the arrow B in FIG. 3 schematically showing the drive gear 26 and photosensors 35 and 36, and FIG. 6(B), FIG. 7(B), and FIG. 8(B) are side views in the direction of the arrow A in FIG. 3 schematically showing the head unit 16 and the platen 2. FIGS. 6(A) and 6(B) show the case where the photosensor 35 for detecting stand-by position is off and the photosensor 36 for detecting printing position 36 is on. In this case, the thermal head 1 is in the stand-by position. Then, FIGS. 7(A) and 7(B) show the case where the photosensor 35 for detecting stand-by position is on and the photosensor 36 for detecting printing position 36 is off. In this case, the thermal head 1 is in the printing position. Finally, FIGS. 8(A) and 8(B) show the case where both the photosensors 35 and 36 are off. In this case, the thermal head 1 is far away from the platen 2 and is in the ribbon exchange position.

Structure for bringing the thermal head 1 to a desired position

Figure 9:
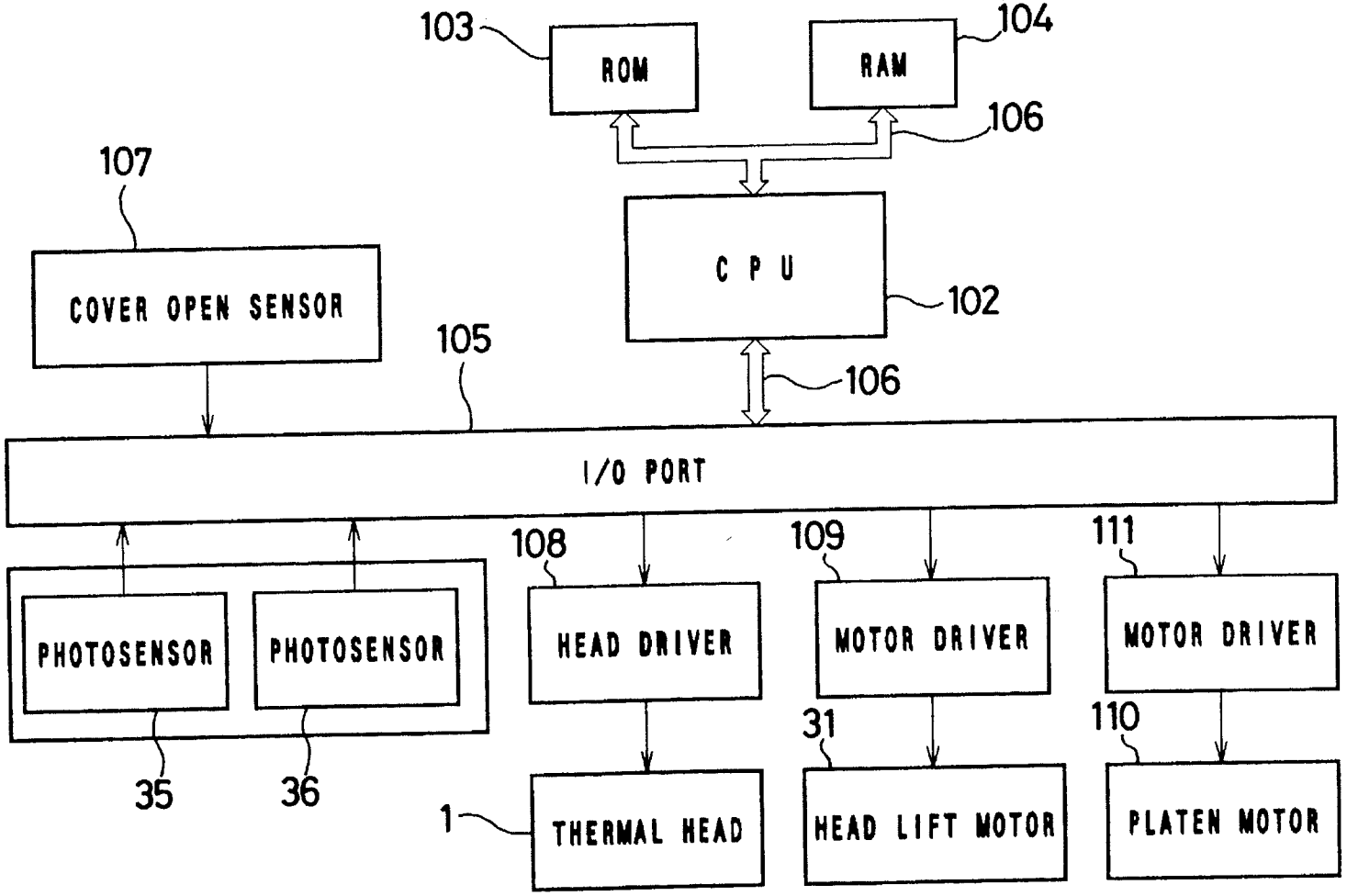
FIG. 9 is a block diagram showing interconnection of electric circuits.

After the position of the thermal head 1 has been detected as described above, the operation of the head lift motor 31 is controlled by a motor control means and a thermal head drive control means (neither of which are shown) according to detected signals from the photosensors 35 and 36. FIG. 9 is a block diagram of electric circuits through which the motor control means performs its controlling operation. Reference numeral 102 denotes a CPU (central processing unit) for controlling a number of parts in a centralized manner, 103 denotes a ROM (read only memory) storing program data used by the CPU 102 for controlling the parts, 104 denotes a RAM (random access memory) used by the CPU 102 as work area and the like in making various data processing, and 105 denotes an I/O port. The CPU 102, ROM 103, RAM 104, and the I/O port 105 are interconnected by a bus line 106. The I/O port 105 is connected with a cover open sensor 107 for detecting that a cover, not shown, of the printer body is opened for example for later described exchanging of an ink ribbon 33, a head driver 108 for driving the thermal head 1, a motor driver 109 for driving the head lift motor 31, and a motor driver 111 for driving the platen motor 110 as the drive source of the platen 2.

Operation of the embodiment will be described below. First, the engagement members 7 are adjusted for position such that the straight line connecting the centers of the cuttings 11 formed in the left and right engagement members 7 is held parallel to the line in which the heating elements 1*a* on the thermal head 1 are arranged and the engagement members 7 are fixed to both sides of the thermal head 1. Then, the back side of the thermal head 1 is fixed to the presser plate 19 and thereby assembling of the head unit 16 is completed. The head unit 16 can be attached to the head press/release mechanism 17 by having the fitting piece 4 of the head supporting member 5 fitted into the circular groove 18*a* around the center shaft 18, with predetermined plays provided in the direction of swinging around the center shaft 18 and in the direction perpendicular to the direction of the swinging.

Figure 10:
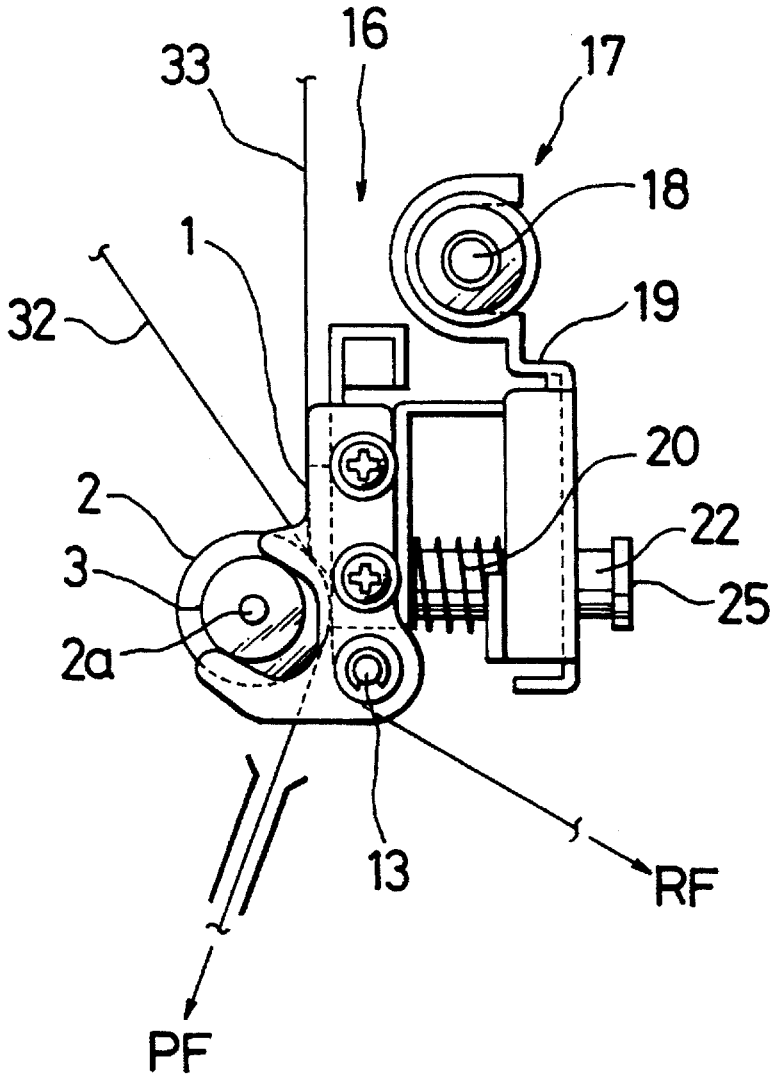
FIG. 10 is a side view of the platen and the head unit showing the paths of the printing paper and ink ribbon.

Then, if the head lift motor 31 is rotated counterclockwise as shown in FIG. 6(B), the center shaft 18, together with the presser plate 19, is swung counterclockwise. Hence, the presser plate 19 pushes the flange 25 of the screw 22 rightward and, thereby, the head unit 16 is brought into the stand-by position separated from the platen 2. In this state, printing paper 32 and the ink ribbon 33 can be passed between the platen 2 and the thermal head 1 (refer to FIG. 10). Thereafter, if the head lift motor 31 is rotated clockwise as shown in FIG. 7(B), then, the center shaft 18, together with the presser plate 19, is swung clockwise and, thereby, the spring 20 is compressed and the thermal head 1 is caused, by the compressive force, to press the printing paper 32 and the ink ribbon 33 against the platen 2, in the printing position. If the thermal head 1 is driven in this state, the ink of the ink ribbon 33 is transferred to the printing paper 32, i.e., printing is executed. As shown in FIG. 10, the printing paper 32 is fed by a feed roller, not shown, in the direction of the arrow PF, while the ink ribbon is taken up by a ribbon reel, not shown, in the direction of the arrow RF. Therefore, the printing paper 32 and the ink ribbon 33 are positively separated on the ribbon guide roller 13.

In the state of the thermal head 1 pressed against the platen 2, the cuttings 11 formed in the engagement members 7 fit on the concentric circular members 3 disposed on the center axis of the platen 2. Therefore, in the assembling work of the head unit 16, by having the engagement members 7 adjusted for position and fixed to both sides of the thermal head 1 such that the straight line connecting the centers of the cuttings 11 formed in the left and right engagement members 7 is held parallel to the line of arrangement of the heating elements 1*a* on the thermal head 1, it can be easily achieved to keep the line of arrangement of the heating elements 1*a* on the thermal head 1 parallel to the center axis of the platen 2 along the feed direction of the printing paper 32. Further, in the device of the present embodiment, by adjusting the head unit 16 as a single unit separated from the printer body, the line of arrangement of the heating elements 1*a* can be adjusted to be parallel to the platen 2. Therefore, such adjustment work becomes very simple.

When the printing paper 32 and the ink ribbon 33 are separated on the ribbon guide roller 13, sometimes the printing paper 32 is pulled by the adhesive force of the ink ribbon 33. On this occasion, if the center axis of the ribbon guide roller 13 is not parallel to the platen 2, or, in other words, if the ribbon guide roller 13 is slanted from the direction perpendicular to the feed direction of the printing paper 32, the printing paper 32 skews. Since, in the present invention, each of the left and right engagement members 7 has the bearing 14 for holding each end of the ribbon guide roller 13 such that the ribbon guide roller 13 is positioned in a straight line parallel to the straight line connecting the centers of the cuttings 11 formed in the engagement members 7, it is quite easy to hold the platen 2 and the ribbon guide roller 13 in parallel with each other. Thus, the printing paper 32 and the ink ribbon 33 passing by the platen 2 can be separated on the ribbon guide roller 13 which is perpendicular to the feed direction of the printing paper 32. Hence, the printing paper 32 can be prevented from skewing.

In the maintenance, the fitting piece 4 of the head unit 16 can be removed from the circular groove 18*a* formed in the head press/release mechanism 17 by such a simple operation to unscrew the screw 22 from the head supporting member 5. Further, the head unit 16 can be coupled to the head press/release mechanism 17 by such a simple operation to fit the fitting piece 4 into the circular groove 18*a* and, then, insert the screw 22 into the presser plate 19 from its back side and screw the screwed portion 24 of the screw 22 into the back side of the head supporting member 5. Accordingly, mounting and dismounting of the thermal head 1 is quite easy.

Figure 11:
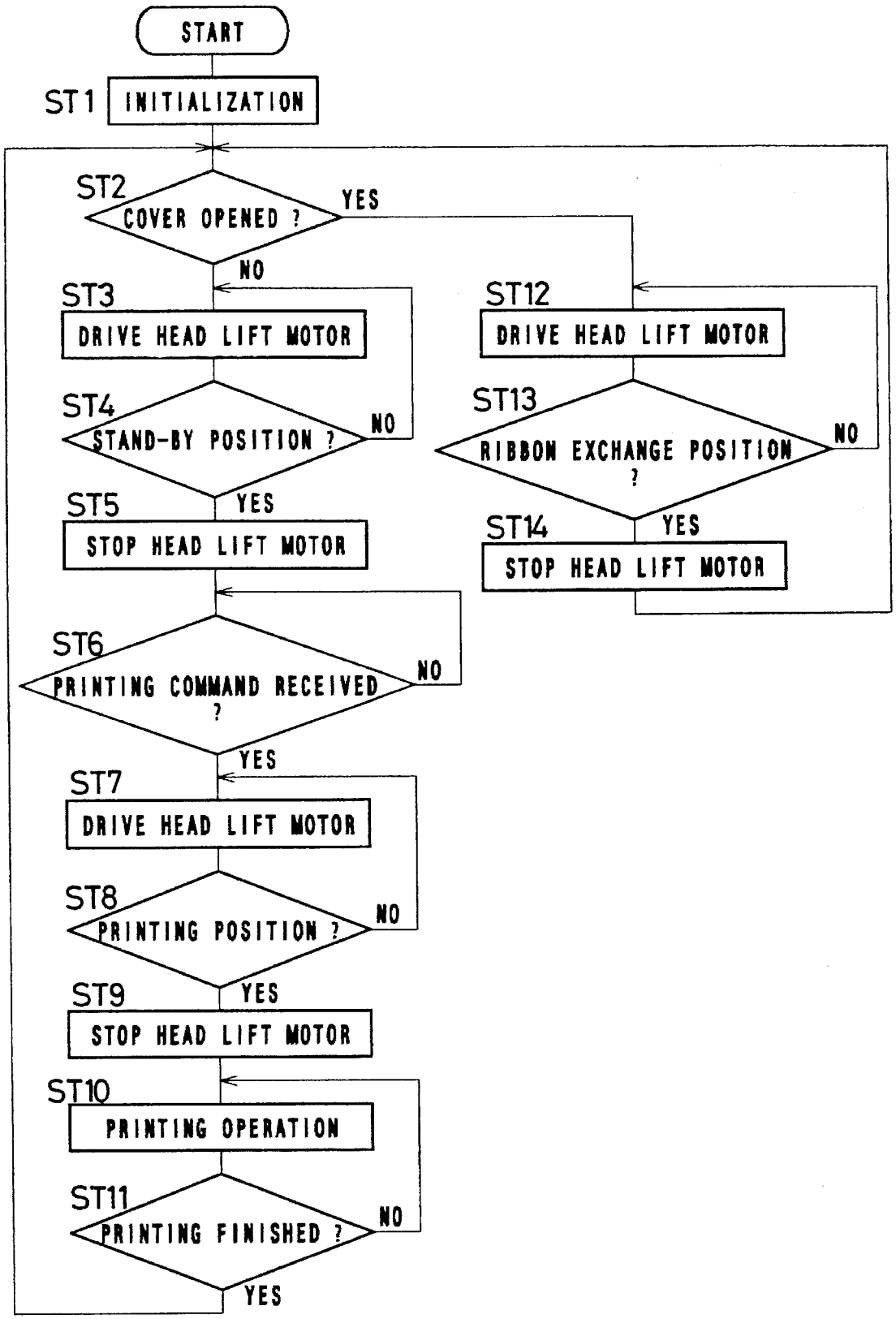
FIG. 11 is a flowchart of processes for bringing the thermal head into the printing position, the stand-by position, and the ribbon exchange position including the printing process.

Flow of processes performed by the CPU 102 in bringing the thermal head 1 into the stand-by position, the printing position, and the ribbon exchange position, together with the process performed in the printer, will be described below. When printing is carried out, for example, according to printing data from an externally-connected host computer, processes are performed as represented in the flowchart of FIG. 11. First, in ST1, predetermined initial setting is made based on the initial setting conditions of the printer body. In ST2, it is determined by the cover open sensor 107 whether the cover of the printer body is opened. If the cover is not opened, the head lift motor 31 is driven in ST3 in the direction such that the thermal head 1 is caused to go away from the platen 2. Then, in ST4, it is determined whether the thermal head 1 is in the stand-by position as shown in FIG. 6(B). The fact that it is in the stand-by position is affirmed by the photosensor 35 being off and, at the same time, the photosensor 36 being on as shown in FIG. 6(A). In ST5, the head lift motor 31 is stopped. At this time, the thermal head 1 is held in the stand-by position as shown in FIG. 6(B).

Then, in ST6, a printing command from the host computer is waited for; meanwhile, it is checked whether the printing paper 32 is set. When it is decided that the printing paper 32 is set and the printing command has been received, the head lift motor 31 is driven in ST7 so that the thermal head 1 is shifted toward the printing position. In ST8, it is determined whether the thermal head 1 is in the printing position as shown in FIG. 7(B). This is affirmed by the photosensor 35 being on and, at the same time, the photosensor 36 being off as shown in FIG. 7(A). If, at this time, it is decided that the thermal head 1 is not in the printing position, the flow returns to ST7, and if it is decided that the thermal head 1 is in the printing position, the flow advances to ST9 in which the head lift motor 31 is stopped. At this time, the thermal head 1 is held in the printing position as shown in FIG. 7(B). Then, in ST10, a predetermined printing operation is made according to printing data from the host computer. In ST11, it is determined whether the printing has been finished, and when it is decided to have been finished, the flow returns to ST2, and when it is decided to have not yet been finished, the flow returns to ST10 for printing processing.

When the cover of the printer body is opened when the printing operation represented in the flowchart of FIG. 11 is to be executed, the fact is detected by the cover open sensor 107 in the processing of ST2. Then, in ST12, the head lift motor 31 is driven in the direction it causes the thermal head 1 to separate from the platen 2. When the position of the cutting for detection 34 in the drive gear 26 relative to the two photosensors 35 and 36 becomes as shown in FIG. 8(A) and, hence, outputs of both the photosensors 35 and 36 go off, it is decided in ST13 that the thermal head 1 is in the ribbon exchange position. Then, the head lift motor 31 is stopped in ST14 and the flow returns to the processing in ST2. Operations by the thermal head drive control means are executed through the above described flow of processes. By having the operations executed by the thermal head drive control means, the thermal head 1 is held in the ribbon exchange position as shown in FIG. 8(B).

In this way, when the ink ribbon 33 is exchanged, the thermal head 1 is positioned further away from the platen 2 than when the thermal head 1 is in the stand-by position. Thus, in the ribbon exchange position, the thermal head 1 is held a considerable distance away from the platen 2 and the ink ribbon 33 can be easily exchanged and, hence, the ink ribbon 33 can be prevented from being damaged. Besides, the stand-by position is set separately from the ribbon exchange position. Therefore, in setting the stand-by position, it is not necessary to consider the ease of exchanging the ink ribbon 33 and, hence, it is not necessary to set the stand-by position far away from the platen 2. Accordingly, the distance of the thermal head 1 relative to the platen 2 in the stand-by position can be set to be the same as before or narrower than that. Thus, the throughput of printing can be kept from lowering.

A second embodiment of the invention will be described with reference to FIG. 12 and FIG. 13. Parts therein like those described in the above described embodiment will be denoted by corresponding reference numerals and duplicated description of the same will be omitted. The idler gear 27, with two ratchet teeth 37 and 38 as engagement portions formed at a portion of its circumference, is provided as a stopper gear 27 in power transmission parts. Further, there is provided an engagement lever 39 to be engaged with either of the ratchet teeth 37 and 38 formed on the circumference of the stopper gear 27. The engagement lever 39, urged in a counterclockwise direction by a spring 40 as the urging member, is swingably supported on a support shaft 41 and also swingably coupled with a plunger 43 of an electromagnet 42.

Figure 12:
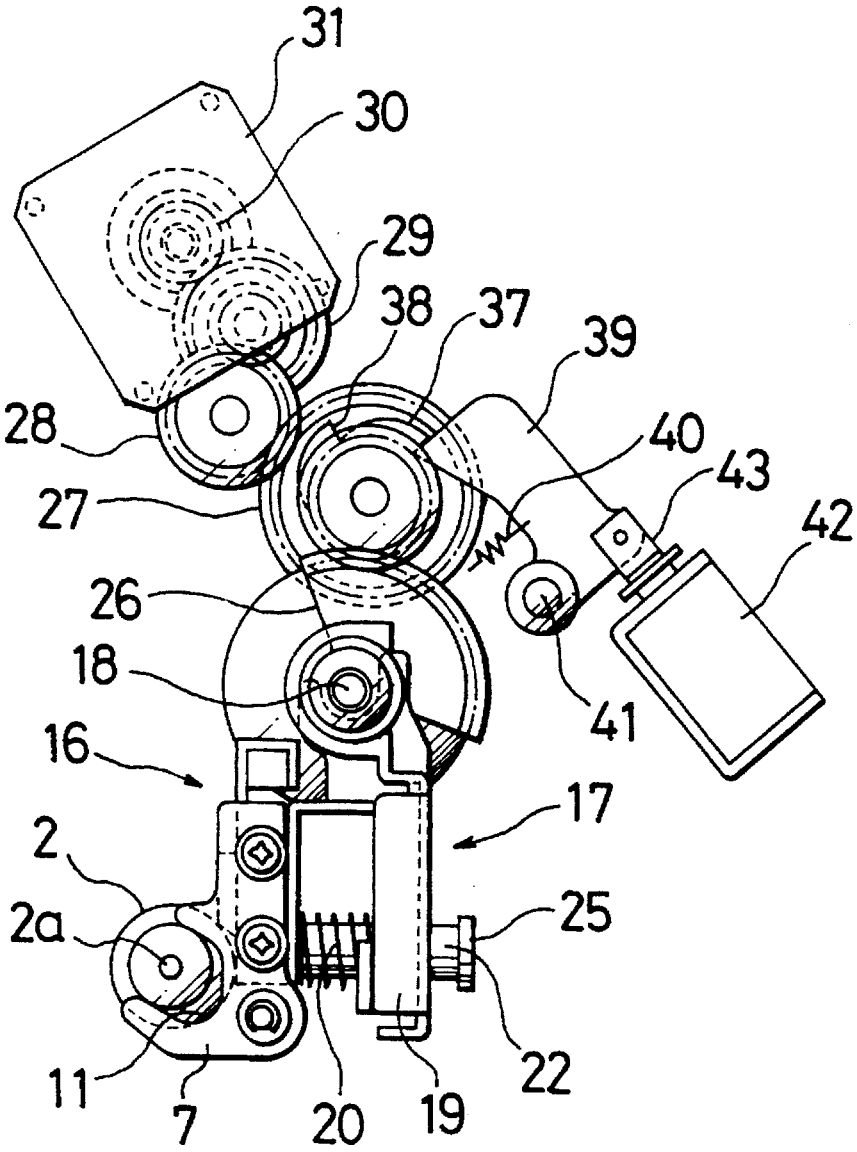
FIG. 12 is a side view of a second embodiment of the invention showing the whole device when the thermal head is in the printing position.

In the above described structure, when the head unit 16 is pressed to the platen 2 by rotation of the head lift motor 31 in a clockwise direction as shown in FIG. 12, the head lift motor 31 is stopped as described in ST5 of the flowchart of FIG. 11. In the embodiment, even if power supply to the head lift motor 31 is cut off on this occasion, the head unit 16 can be steadily held in the right printing position. More specifically, since the engagement lever 39 is engaged with the ratchet tooth 37 by the urge of the spring 40, it is made possible, by means of the engagement lever 39 to prevent the presser plate 19 from moving in the direction it separates from the platen 2 by the resilience of the spring 20.

When separating the head unit 16 from the platen 2 in the printing position shown in FIG. 12, the engagement lever 39 is disengaged from the ratchet tooth 37 free of resistance by exciting the electromagnet 42 while the stopper gear 27 is slightly moved counterclockwise by the head lift motor 31 driven several pulses clockwise. Thus, the engagement lever 39 can be separated from the stop gear 27. In this state, the head lift motor 31 is rotated counterclockwise as shown in FIG. 13 and the head lift motor 31 is stopped at the point of time when the photosensor 36 detects the cutting for detection 34 formed in the drive gear 26. In this way, the head unit 16 is brought into the position where it is held apart from the platen 2. When the engagement lever 39 has come into contact with the back side of the ratchet tooth 37 in the course of operation, power to the electromagnet 42 is cut off.

Figure 13:
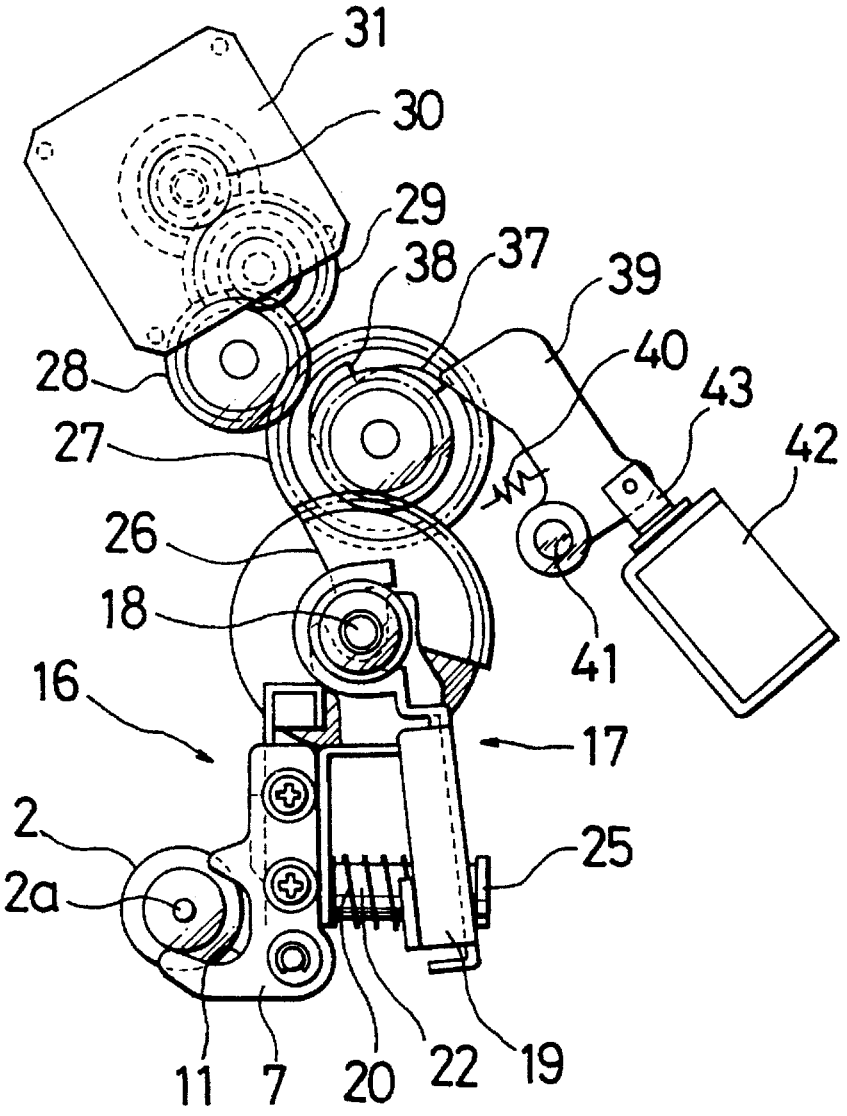
FIG. 13 is a side view of the whole device when the thermal head is in the stand-by position.

If the head lift motor 31 is further rotated counterclockwise from the state shown in FIG. 13, the engagement lever 39 comes to be engaged with the ratchet tooth 38 in the ribbon exchange position and, thereby, the stopper gear 27 is prevented from rotating. In this state, the head unit 16 is held far away from the platen 2 and, accordingly, such work as exchanging the ink ribbon 33 can be executed easily.

According to the present embodiment, power supply to the head lift motor 31 can be cut off in the stand-by position, the printing position, and the ribbon exchange position of the thermal head 1. Therefore, overheat of the head lift motor 31 can be prevented.

What is claimed is:

1. A thermal head supporting device comprising:

a pair of positioning members disposed at both ends and on a center axis of a platen, said positioning members being of the same shape and size;

a head press/release mechanism movable toward and away from said platen; and a head unit, said head unit comprising:

a head supporting member removably coupled to said head press/release mechanism with a predetermined play;

a thermal head having a plurality of heating elements arranged in a straight line thereon and being supported on said head supporting member such that said heating elements are disposed in confronting relationship with said platen; and a pair of engagement members attached to both sides of said thermal head adjustably for position and having a pair of cuttings formed therein allowing said positioning members to be removably fitted therein, said cuttings being of the same shape and size;

wherein said thermal head is adjustably attached for position to said pair of engagement members by having screws screwed into screw holes formed in said thermal head through fixing holes formed in said engagement members having a larger diameter than said screw holes.

2. A thermal head supporting device according to claim 1, wherein said positioning members are formed of circular members concentrically disposed with said platen.

3. A thermal head supporting device according to claim 2, wherein said positioning members are formed larger in diameter than the supporting shaft of said platen.

4. A thermal head supporting device comprising:

a pair of positioning members disposed at both ends and on a center axis of a platen, said positioning members being of the same shape and size;

a head press/release mechanism movable toward and away from said platen; and a head unit, said head unit comprising:

a head supporting member removably coupled to said head press/release mechanism with a predetermined play;

a thermal head having a plurality of heating elements arranged in a straight line thereon and being supported on said head supporting member such that said heating elements are disposed in confronting relationship with said platen; and a pair of engagement members attached to both sides of said thermal head adjustably for position and having a pair of cuttings formed therein allowing said positioning members to be removably fitted therein, said cuttings being of the same shape and size;

wherein said head supporting member is swingably coupled to said head press/release mechanism, and said pair of cuttings formed in said engagement members are engaged with and disengaged from said positioning members as said head supporting member swings with respect to said head press/release mechanism.

5. A thermal head supporting device comprising:

a pair of positioning members disposed at both ends and on a center axis of a platen, said positioning members being of the same shade and size;

a head press/release mechanism movable toward and away from said platen; and a head unit, said head unit comprising:

a head supporting member removably coupled to said head press/release mechanism with a predetermined play;

a thermal head having a plurality of heating elements arranged in a straight line thereon and being supported on said head supporting member such that said heating elements are disposed in confronting relationship with said platen; and a pair of engagement members attached to both sides of said thermal head adjustably for position and having a pair of cuttings formed therein allowing said positioning members to be removably fitted therein, said cuttings being of the same shape and size;

the thermal head supporting device further comprising a laterally elongated ribbon guide roller for turning a path of an ink ribbon, which has been led to a printing position between said thermal head and said platen and forwarded past said printing position, into a direction along which the ink ribbon separates from printing paper led to said printing position, and roller supporting members, provided in said engagement members positioned in a straight line parallel to a straight line connecting centers of said cuttings formed in said engagement members, for supporting both ends of said ribbon guide roller.

6. A thermal head supporting device comprising:

a pair of positioning members disposed at both ends and on a center axis of a platen, said positioning members being of the same shape and size;

a head press/release mechanism movable toward and away from said platen; and a head unit, said head unit comprising:

a head supporting member removably coupled to said head press/release mechanism with a predetermined play;

a thermal head having a plurality of heating elements arranged in a straight line thereon and being supported on said head supporting member such that said heating elements are disposed in confronting relationship with said platen; and a pair of engagement members attached to both sides of said thermal head adjustably for position and having a pair of cuttings formed therein allowing said positioning members to be removably fitted therein, said cuttings being of the same shape and size;

wherein said head press/release mechanism includes:

a rotatably driven input portion disposed in parallel with said platen;

a presser plate fixed to said input portion;

means for moving the presser plate toward and away from said platen, said presser plate being coupled with said head supporting member in a manner which permits a predetermined play; and a spring disposed between said presser plate and said head unit in a compressed state.

7. A thermal head supporting device according to claim 6, further comprising a semicircular fitting piece formed on said head supporting member, wherein said head press/release mechanism further includes:

a circular groove formed in said input portion allowing said semicircular fitting piece to fit therein with a predetermined play, a circular hole formed in said presser plate, and a stopper portion, with a flange larger in diameter than said circular hole and a portion formed smaller in diameter than said circular hole, having said portion smaller in diameter passed through said circular hole to be detachably attached to said head unit, whereby said head supporting member is removably coupled to said head press/release mechanism with a predetermined play.

8. A thermal head supporting device according to claim 6, further comprising a plurality of said springs along a direction of the center axis of said platen.

9. A thermal head supporting device according to claim 6, further comprising a motor for driving said input portion.

10. A thermal head supporting device according to claim 9, further comprising: position detecting means for detecting a position of at least one of said head press/release mechanism and a drive mechanism of a power transmission part for coupling said motor and said head press/release mechanism; and motor control means for controlling an operation of said motor on a basis of a detected signal by said position detection means.

11. A thermal head supporting device according to claim 10, further comprising an engagement portion formed on a stopper gear of the power transmission part coupling said motor and said head press/release mechanism, an engagement lever movable between a position where the engagement lever engages said engagement portion and a position where the engagement lever disengages from said engagement portion, an urging member for urging said engagement lever in one direction, and an electromagnet supplied with power for pulling said engagement lever in the other direction.

12. A thermal head supporting device comprising:

a pair of positioning members disposed at both ends and on a center axis of a platen, said positioning members being of the same shape and size;

a head press/release mechanism movable toward and away from said platen; and a head unit, said head unit comprising:

a head supporting member removably coupled to said head press/release mechanism with a predetermined play;

a thermal head having a plurality of heating elements arranged in a straight line thereon and being supported on said head supporting member such that said heating elements are disposed in confronting relationship with said platen; and a pair of engagement members attached to both sides of said thermal head adjustably for position and having a pair of cuttings formed therein allowing said positioning members to be removably fitted therein, said cuttings being of the same shape and size;

the thermal head supporting device further comprising means for selectively positioning said thermal head, as said head press/release mechanism is moved relative to said platen, in a printing position where said heating elements are pressed to said platen, a stand-by position where said heating elements are kept away from said platen, and a ribbon exchange position where said heating elements are kept further away from said platen.

13. A thermal head supporting device according to claim 12, further comprising a motor for driving said head press/release mechanism, stand-by position detection means for detecting said thermal head located in said stand-by position, printing position detection means for detecting said thermal head located in said printing position, motor control means for controlling operation of said motor on the basis of detected outputs by said stand-by position detection means and said printing position detection means, and thermal head drive control means for driving said head press/release mechanism with said motor in the direction such that said thermal head is separated from said platen and stopping the drive of said head press/release mechanism when said printing position detection means and said stand-by position detection means do not detect said thermal head.

* * * * *